US011053763B2

(12) United States Patent
Kadam et al.

(10) Patent No.: US 11,053,763 B2
(45) Date of Patent: Jul. 6, 2021

(54) METHOD AND APPARATUS FOR PINCHING CONTROL LINES

(71) Applicant: Halliburton Energy Services, Inc., Houston, TX (US)

(72) Inventors: Ratish Suhas Kadam, Singapore (SG); Abhay Raghunath Bodake, Singapore (SG); Mukesh Bhaskar Kshirsagar, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 134 days.

(21) Appl. No.: 16/475,510

(22) PCT Filed: Jul. 3, 2018

(86) PCT No.: PCT/US2018/040787

§ 371 (c)(1),
(2) Date: Jul. 2, 2019

(87) PCT Pub. No.: WO2020/009695

PCT Pub. Date: Jan. 9, 2020

(65) Prior Publication Data

US 2021/0115745 A1 Apr. 22, 2021

(51) Int. Cl.

| | |
|---|---|
| ***E21B 29/04*** | (2006.01) |
| ***E21B 29/08*** | (2006.01) |
| *E21B 29/00* | (2006.01) |

(52) U.S. Cl.

CPC ..... *E21B 29/04* (2013.01); *E21B 29/08* (2013.01); *E21B 29/002* (2013.01)

(58) Field of Classification Search

CPC ..... E21B 29/04; E21B 17/026

See application file for complete search history.

(56) References Cited

U.S. PATENT DOCUMENTS 969,755 A * 9/1910 Spang ..... E21B 29/04 166/54.6
1,403,470 A * 1/1922 McKain ..... E21B 29/04 166/54.5

(Continued)

FOREIGN PATENT DOCUMENTS

| | | |
|---|---|---|
| EP | 2813665 | 12/2014 |
| WO | 2004011768 | 2/2004 |
| WO | 2015175025 | 11/2015 |

OTHER PUBLICATIONS

ISRWO International Search Report and Written Opinion for PCT/US2018/040787 dated Mar. 22, 2019.

(Continued)

*Primary Examiner* — Kipp C Wallace

(74) *Attorney, Agent, or Firm* — Scott Richardson; C. Tumey Law Group, PLLC

(57) ABSTRACT

A control line pinching mechanism can include a pinching sleeve, a clamping sleeve, a tubing, a control line, and a pinching block. The clamping sleeve can have a slot. A control line can extend between the tubing and the slot of the clamping sleeve. A pinching block can be disposed within the slot of the clamping sleeve. The pinching sleeve can be movable relative to the slot from a released position to a pinching position in which the pinching sleeve contacts and radially compresses the pinching block against the control line to pinch the control line against the tubing.

20 Claims, 6 Drawing Sheets

(56) References Cited

U.S. PATENT DOCUMENTS

| | | | | |
|---|---|---|---|---|
| 1,491,610 | A * | 4/1924 | Liady | E21B 29/04 166/54.6 |
| 4,981,177 | A * | 1/1991 | Carmody | E21B 29/08 166/298 |
| 6,789,627 | B2 | 9/2004 | Leismer | |
| 6,997,262 | B2 * | 2/2006 | Palmer | E21B 29/04 166/298 |
| 7,128,155 | B2 | 10/2006 | Cho | |
| 7,963,319 | B2 * | 6/2011 | Daigle | E21B 17/026 166/54.5 |
| 8,333,236 | B2 * | 12/2012 | Guidry | E21B 29/04 166/55.3 |
| 9,624,745 | B2 * | 4/2017 | Sorbo | E21B 29/04 |
| 2001/0045283 | A1 | 11/2001 | Leismer | |
| 2005/0006102 | A1 | 1/2005 | Cho | |
| 2006/0048950 | A1 * | 3/2006 | Dybevik | E21B 33/1208 166/387 |
| 2014/0102806 | A1 * | 4/2014 | Millet | E21B 17/028 175/315 |
| 2014/0326470 | A1 * | 11/2014 | Tinnen | E21B 33/134 166/385 |
| 2016/0138354 | A1 * | 5/2016 | Sorbo | E21B 29/08 166/298 |
| 2016/0245031 | A1 | 8/2016 | Clemens | |
| 2016/0326822 | A1 * | 11/2016 | Tait | E21B 29/04 |

OTHER PUBLICATIONS

May Bente Leifsen Valdal, Plug and Abandonment Operations Performed Riserless Using a Light Well Intervention Vessel, University of Stavanger, Faculty of Science and Technology Master Thesis, 2013.

* cited by examiner

METHOD AND APPARATUS FOR PINCHING CONTROL LINES

TECHNICAL FIELD

The present description relates in general to splice assemblies, and more particularly, for example and without limitation, to methods and apparatuses for pinching control lines upon separation thereof.

BACKGROUND OF THE DISCLOSURE

In the oil and gas industry, hydrocarbons are produced from wellbores traversing subterranean hydrocarbon producing formations. Many current well completions include intelligent well completions, which allow for control of individual reservoir zones. Intelligent well completions can be completed with control lines, which run to individual reservoir zones. The control lines can be electrical and/or hydraulic control lines run along and/or coupled to the tubing.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

This section provides various example implementations of the subject matter disclosed, which are not exhaustive. As those skilled in the art would realize, the described implementations may be modified without departing from the scope of the present disclosure. Accordingly, the drawings and description are to be regarded as illustrative in nature and not restrictive.

The present description relates in general to splice assemblies, and more particularly, for example and without limitation, to methods and apparatuses for pinching control lines upon separation thereof.

After production of hydrocarbons from a reservoir zone is completed, the reservoir zone can be plugged and abandoned. During abandonment, tubing uphole of the zone is cut and removed, allowing for the cementing of the tubing and annulus remaining downhole. When abandoning reservoir zones with intelligent completions, control lines are disconnected, cut, severed, or otherwise separated to allow removal of the cut tubing as well as portions of the control line uphole of the abandoned zone.

In some applications, upon separation of hydraulic control lines, fluid contained within the hydraulic control lines may spill into the wellbore. Further, flow from one control line may be introduced into another control line, creating zonal cross-flow.

An aspect of at least some embodiments disclosed herein is the realization that by pinching control lines, spillage and zonal cross-flow during separation is prevented. Another aspect of at least some embodiments disclosed herein is the realization that by pinching control lines, a reservoir zone can be plugged and abandoned without the use of a rig.

Figure 1:
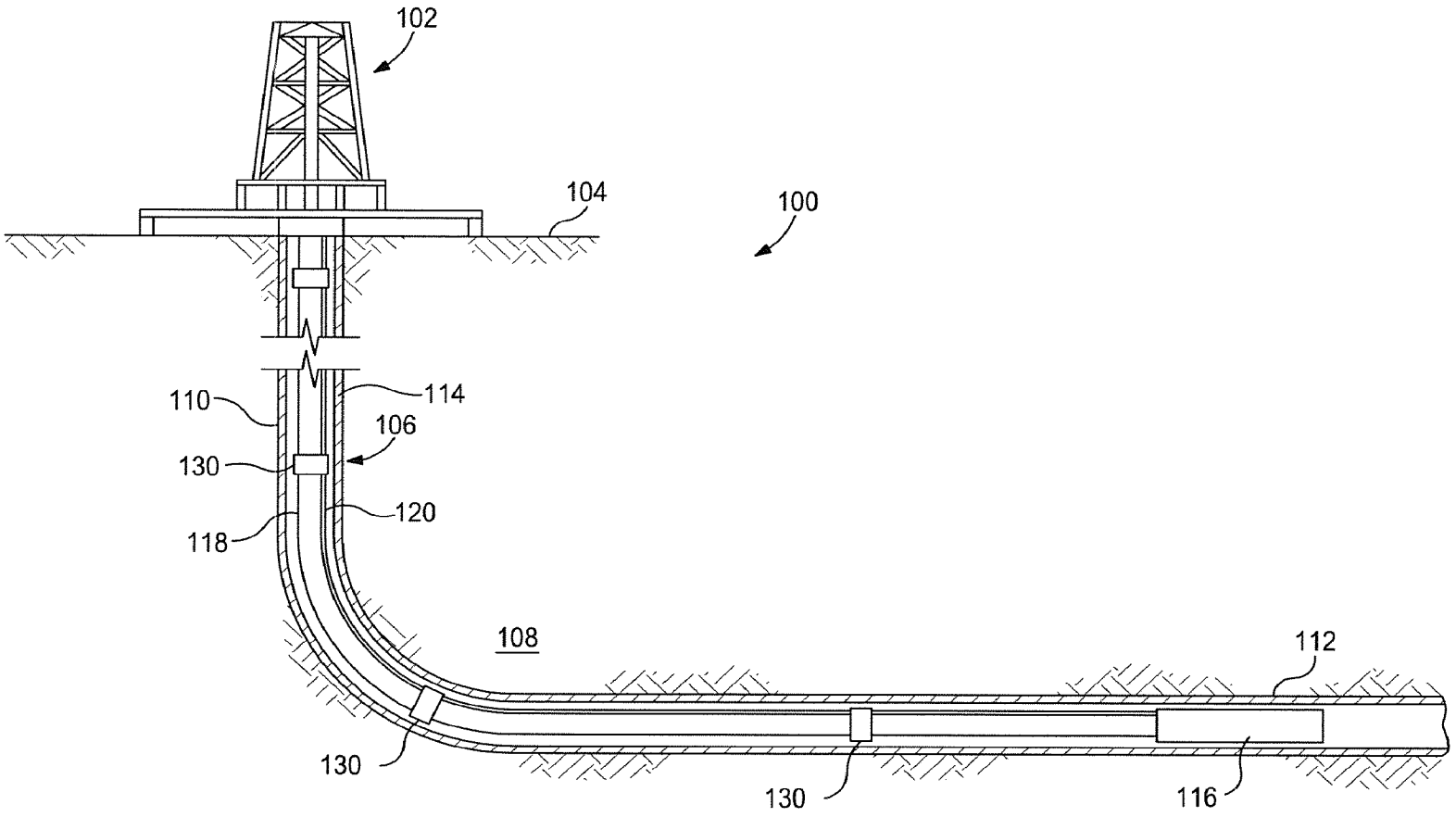
FIG. 1 is a cross-sectional view of a well system that can employ the principles of the present disclosure, according to some embodiments.

FIG. 1 is a cross-sectional view of a well system that can employ the principles of the present disclosure, according to some embodiments. As illustrated, the well system 100 may include a service rig 102 positioned on the earth's surface 104 and extends over and around a wellbore 106 that penetrates one or more subterranean formations 108. The service rig 102 may be a drilling rig, a completion rig, a workover rig, or the like. In some embodiments, the service rig 102 may be omitted and replaced with a standard surface wellhead completion or installation. Moreover, while the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof.

The well system 100 may further include intelligent completion tools 116 configured to be disposed within a reservoir zone in order to perform one or more wellbore operations. As illustrated, the intelligent completion tools 116 may coupled or otherwise attached to a tubing 118 that extends from the service rig 102. The tubing 118 may be, but is not limited to, drill string or pipe, production tubing or pipe, coiled tubing, chemical injection lines, power cables, or any other rigid or semi-rigid tubular or string of tubulars that can be inserted into the wellbore 106. Intelligent completion tools 116 can be disposed within multiple zones along the wellbore 106.

One or more control lines 120 may be coupled or otherwise attached to the outer surface of the tubing 118. Although only one control line 120 is depicted in FIG. 1, it will be appreciated that any number of control lines 120 may be attached to the exterior of the tubing 118, without departing from the scope of the disclosure. The control line 120 may be representative of or otherwise include one or more hydraulic lines, one or more electrical lines, one or more fiber optic lines, or other types of control lines known to those skilled in the art. Accordingly, the term "control line" as used herein may broadly refer to any tubular structure or line coupled to the exterior of the tubing 118.

As illustrated, the control line 120 may extend externally to the tubing 118 until being communicably coupled to the intelligent completion tools 116 at its distal end. The control line 120 may be configured to communicably couple the intelligent completion tools 116 to the service rig 102, such that power may be provided to various downhole equipment associated with the intelligent completion tools 116. The control line 120 may also be used as a bi-directional communication line configured to convey command signals and otherwise transmit data between the intelligent completion tools 116 and the service rig 102.

After production of hydrocarbons from the reservoir zone is completed, the reservoir zone may be plugged and abandoned. To facilitate plugging and abandoning, one or more splice subs 130 releasably couple control lines 120 along the tubing 118. In some embodiments, the tubing 118 is cut adjacent to the splice sub 130 to allow the upper portion of the tubing 118 to be removed. As the tubing 118 is removed, the control lines 120 can be disconnected at the splice sub 130 to allow the upper portion of the control lines 120 to be removed with the portion of cut tubing 118. Advantageously, as the control lines 120 are disconnected at the splice sub 130, the splice sub 130 can further pinch the control lines 120 to prevent spillage into the wellbore 106 and cross zonal flow into and across the control lines 120.

Figure 2:
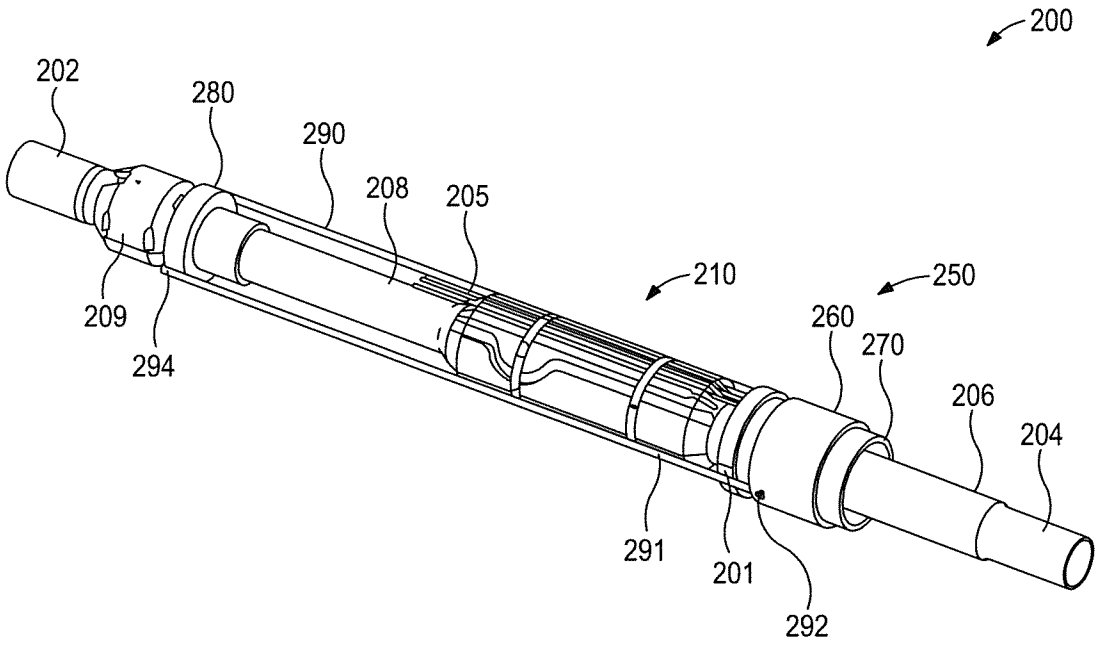
FIG. 2 is perspective view of a splice sub, according to some embodiments.

FIG. 2 is perspective view of a splice sub, according to some embodiments. As illustrated, the splice sub 200 facilitates plugging and abandoning operations. During operation, the splice sub 200 permits the removal of an upper tubing 202 and upper control lines 205 coupled thereto.

The tubing 206 of the splice sub 200 can be cut along the cut zone 208, to define an upper tubing 202 and a lower tubing 204. The cut zone 208 can be located between an upper sleeve 280 of a control line pinching mechanism 250 and a control line splice bracket 210.

Further, the tubing 206 can be cut or separated at the cut zone 208 with conventional methods, including, but not limited to a tubing cutter, a cutting torch, and/or a saw. Upon separation of the upper tubing 202 and the lower tubing 204 at the cut zone 208, the upper tubing 202 can be pulled uphole.

Upper control lines 205 coupled to the upper tubing 202 may be coupled or otherwise connected to lower control lines 201 coupled to the lower tubing 204, effectively coupling the upper tubing 202 to the lower tubing 204 and preventing retrieval of the upper tubing 202. As illustrated, the control line splice bracket 210 retains the lower control lines 201 to facilitate the disconnection of the upper control lines 205 from the lower control lines 201.

As illustrated, the upper control lines 205 and the lower control lines 201 pass through the control line splice bracket 210. In the depicted example, the lower control lines 201 are coupled or retained to the control line splice bracket 210. The upper control lines 205 can be coupled to the lower control lines 201 with connectors or terminations, but the upper control lines 205 may be disposed within, and not be coupled to the control line splice bracket 210. During removal of the upper tubing 202, the upper control lines 205 are pulled uphole with the upper tubing 202. As the pulling force of the upper control lines 205 overcomes the release strength of the connection to the lower control lines 201, the upper control lines 205 are released and separated while the lower control lines 201 are held stationary within the control line splice bracket 210.

In some embodiments, as the lower control lines 201 are disconnected from the upper control lines 205, the lower control lines 201 may leak or spill fluid from within the lower control lines 201 into the wellbore or have cross-flow therebetween. Therefore, prior to, during, or after disconnection of the lower control lines 201, the lower control lines 201 can be crimped, pinched, occluded, or otherwise caused to restrict fluid therein from flowing out into the wellbore.

Figure 6:
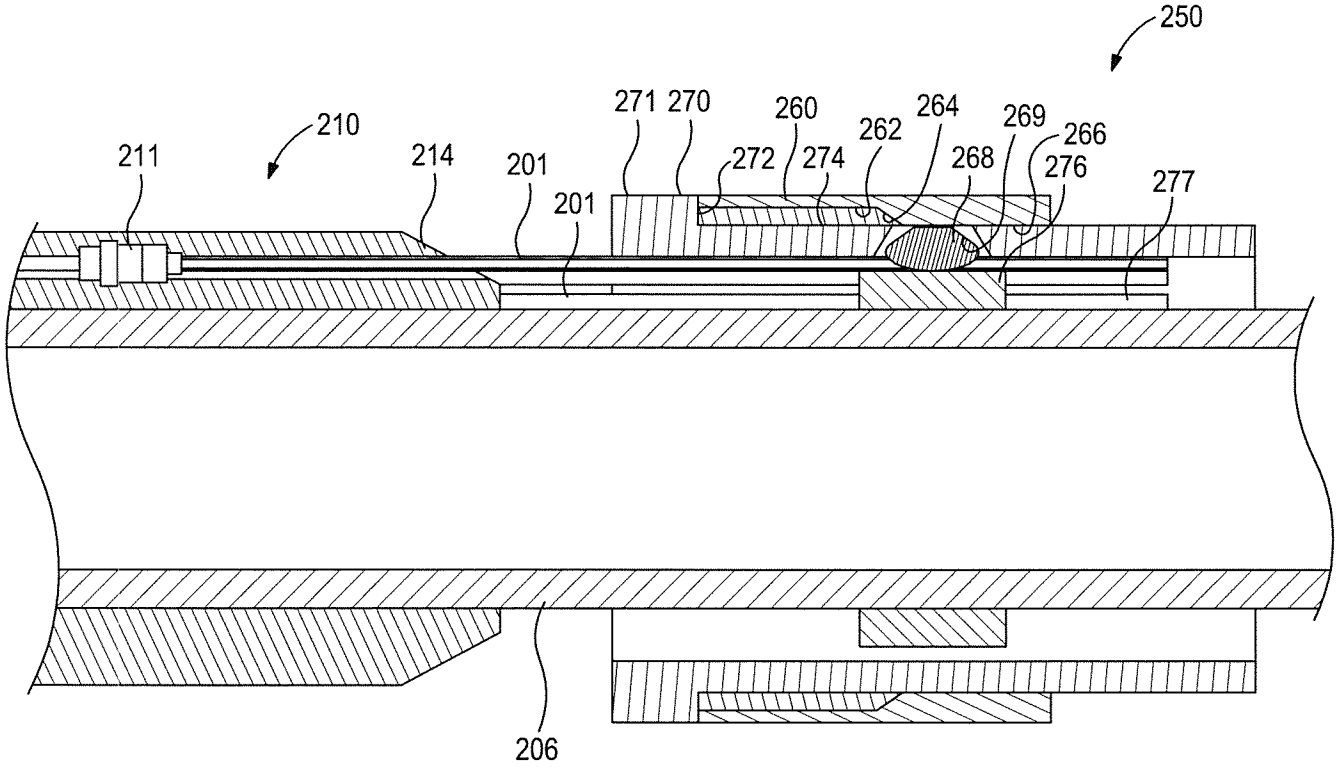
FIG. 6 is a cross-sectional view of the control line pinching mechanism of FIG. 4, taken along lines 5-5, wherein the control line pinching mechanism is in a pinching position, according to some embodiments.

As illustrated, the control line pinching mechanism 250 can pinch the lower control lines 201 before, during, or after disconnection of the lower control lines 201 from the upper control lines 205. For example, as illustrated in FIG. 6, the control line pinching mechanism 250 can obstruct flow through the lower control lines 201 after disconnection of the lower control lines 201 from the upper control lines 205.

The control line pinching mechanism 250 includes a pinching sleeve 260 and a clamping sleeve 270 disposed around the lower control lines 201 and the lower tubing 204. As described herein, the pinching sleeve 260 can be translated uphole relative to the lower tubing 204 to pinch the lower control lines 201 to prevent flow therethrough. After the lower control lines 201 are pinched, the uphole travel of the pinching sleeve 260 can be stopped or limited by a shoulder or other feature of the clamping sleeve 270.

In the depicted example, movement of the cut upper tubing 202 relative to the lower tubing 204 actuates the pinching sleeve 260. As illustrated, the upper tubing 202 couples to the pinching sleeve 260, to allow movement of the cut upper tubing 202 to actuate the pinching sleeve 260 relative to the lower tubing 204.

For example, in some embodiments, as illustrated in FIG. 2, the splice sub 200 can comprise one or more actuation rods 290 to couple the pinching sleeve 260 to the upper tubing 202. The actuation rods 290 can form part of a mechanism that, via movement of the cut upper tubing 202, actuates the pinching sleeve 260. As shown, the actuation rods 290 can pass through actuation rod channels 291 formed through the control line splice bracket 210 to permit the actuation rods 290 to pass therethrough. In some embodiments, altering the length of the actuation rods 290 can adjust the timing of actuation of the pinching sleeve 260 relative to the disconnection of the lower control lines 201. For example, longer actuation rods 290 can allow for the lower control lines 201 to be disconnected before obstructing the lower control lines, while shorter actuation rods 290 can allow for the lower control lines 201 to be obstructed prior to disconnection thereof.

As illustrated, an upper sleeve 280 couples the actuation rods 290 to the upper tubing 202. The upper sleeve 280 is coupled to move with the upper tubing 202. Optionally, the upper sleeve 280 is coupled to an upper sub 209 of the upper tubing 202.

In some embodiments, the splice sub 200 can optionally comprise one or more shear devices 294 that couple the actuation rods 290 to the upper sleeve 280. The shear devices 294 may be configured to transfer and withstand the forces required to actuate or move the pinching sleeve 260 from a released position (e.g., shown in FIGS. 2, 3, and 5) to a pinching position (e.g., shown in FIGS. 4 and 6).

After the pinching sleeve 260 is moved to the pinching position, the actuation rods 290 can be released from the upper sleeve 280 to permit the upper tubing 202 to be retrieved from the wellbore. For example, as the pinching sleeve 260 reaches the pinching position, the uphole travel of the pinching sleeve 260 can be stopped or limited. As-continued uphole force is exerted on the upper tubing 202, the pulling force exerted through the actuation rods 290

(and therefore, also on the shear devices 294) increases. As the pulling force exceeds the shear strength of the shear devices 294, the shear devices 294 are shorn. This allows the actuation rods 290 to be released from the upper sleeve 280 and the upper tubing 202, permitting retrieval of the upper tubing 202. In some embodiments, the actuation rods 290 are coupled to the pinching sleeve 260 with fasteners 292 that function as shear devices. Similarly, if the pulling force exceeds the shear strength of the fasteners 292, the fasteners 292 can be shorn, allowing the actuation rods 290 to be released from the pinching sleeve 260.

Figure 3:
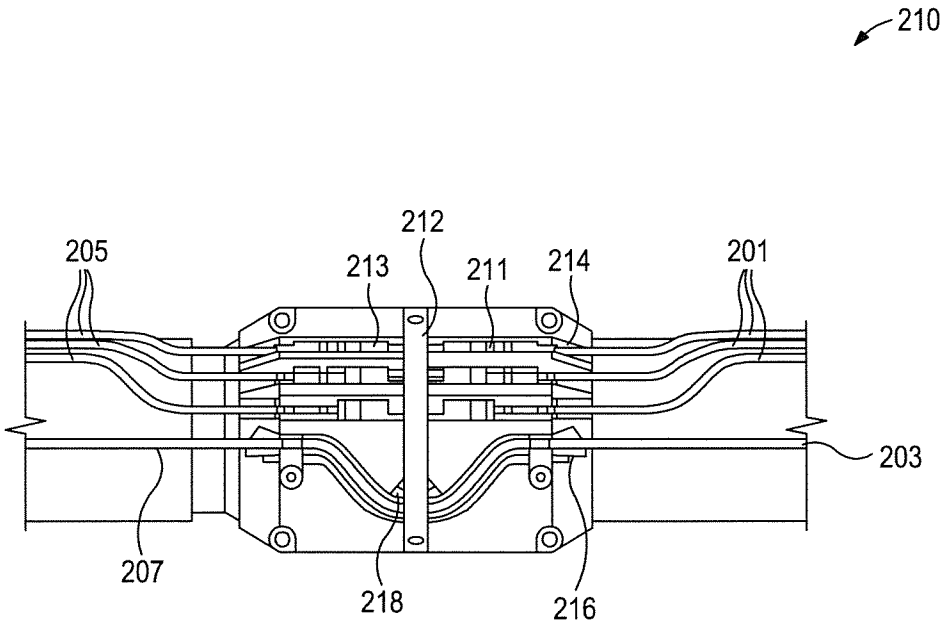
FIG. 3 is a perspective view of a control line splice bracket of the splice sub of FIG. 2, according to some embodiments.

FIG. 3 is a perspective view of a control line splice bracket of the splice sub of FIG. 2, according to some embodiments. As illustrated, the upper control lines 205 are terminated at upper connectors or terminations 213 and the lower control lines 201 terminated at lower connectors or terminations 211. As shown, the upper terminations 213 couple to the lower terminations 211 to mechanically couple and allow fluid communication between the upper control lines 205 and the lower control lines 201.

Optionally, the upper terminations 213 and the lower terminations 211 are engaged together with metal-to-metal seals. In some embodiments, the upper terminations 213 and the lower terminations 211 utilize full metal jacket construction. During operation, the upper terminations 213 and the lower terminations 211 can be pulled apart to disengage or release the upper control lines 205 from the lower control lines 201. The pulling or separation force required to release the upper terminations 213 and the lower terminations 211 can be selected to withstand a desired pulling force as well as prevent damage to the upper control lines 205 and the lower control lines 201.

To facilitate release of the upper terminations 213 from the lower terminations 211 during removal of the tubing, the control line splice bracket 210 can include one or more control line channels 214. The control line channels 214 retain or hold the lower terminations 211 during separation of the upper control lines 205 from the lower control lines 201.

In the depicted example, the one or more of the lower terminations 211 engages with the control line channel 214 to prevent axial movement of the lower termination 211 and the lower control line 201 relative to the control line splice bracket 210. In some embodiments, a clamp 212 can further engage the lower termination 211 to retain the lower termination 211 within the control line channel 214. Optionally, the control line channel 214 may allow rotation of the lower termination 211 therewithin.

Advantageously, during operation, by retaining the lower termination 211 to the control line splice bracket 210, pulling force from the upper control lines 205 can be directed to reliably separate the upper terminations 213 from the lower terminations 211, instead of moving the lower terminations 211. By preventing movement of the lower terminations 211, stretching, deforming, twisting, or otherwise damaging the lower control lines 201 can be avoided.

Optionally, the well system can utilize electrical control lines that may be separated to allow for reliable removal of the upper tubing. As illustrated, a lower electrical line 203 and an upper electrical line 207 may pass through the control line splice bracket 210 as a continuous electrical line. Cutting and separating the continuous electrical line into the upper electrical line 207 and the lower electrical line 203 can facilitate removal of the upper tubing.

In some embodiments, the upper electrical line 207 and the lower electrical line 203 pass through a curved electrical channel 216. Optionally, the clamp 212 can retain the uncut upper electrical line 207 and lower electrical line 203. A cutter 218 can be disposed at an inner radius of the curved electrical channel 216, spaced apart from the electrical line prior to removal of the upper tubing.

During operation, as the uncut upper electrical line 207 and lower electrical line 203 experience a pulling force from the upper tubing, the electrical line can engage against the inner radius of the curved electrical channel 216. Therefore, as the uncut upper electrical line 207 and lower electrical line 203 is pulled, the electrical line can be cut against the cutter 218, separating the upper electrical line 207 and the lower electrical line 203.

Figure 4:
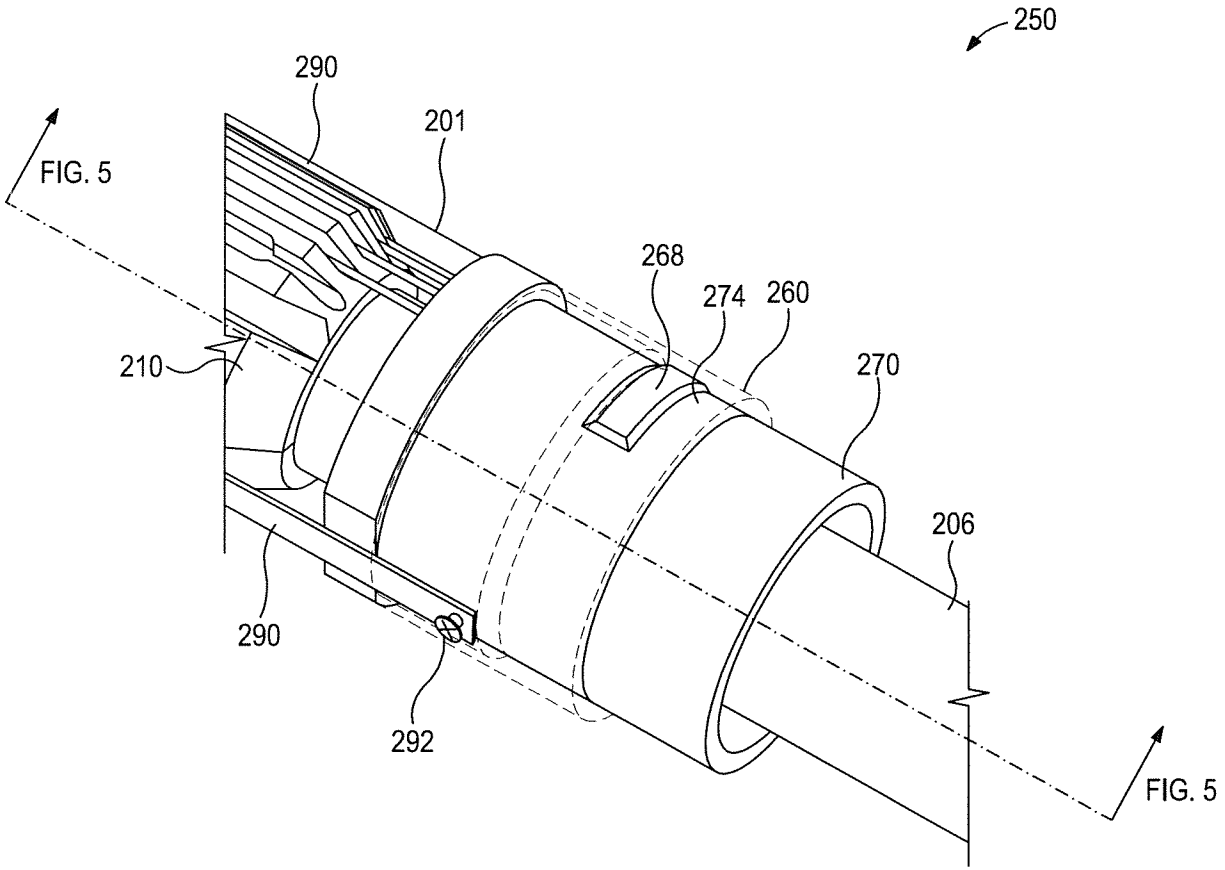
FIG. 4 is a perspective view of the control line pinching mechanism of the splice sub of FIG. 2 with the pinching sleeve shown in dashed lines, according to some embodiments.

FIG. 4 is a perspective view of the control line pinching mechanism of the splice sub of FIG. 2 with the pinching sleeve shown in dashed lines, according to some embodiments. In the depicted example, the actuation rods 290 can move or translate the pinching sleeve 260 relative to the clamping sleeve 270 and/or the tubing 206. As illustrated, fasteners 292 couple the actuation rods 290 to the pinching sleeve 260 to allow the pinching sleeve 260 to move with the actuation rods 290. As previously described, the fasteners 292 can be configured to shear to release the actuation rods 290 from the pinching sleeve 260, permitting retrieval of the upper tubing.

As previously described, the actuation rods 290 can move with the cut upper tubing. Therefore, as the upper tubing is moved uphole, the actuation rods 290 can move the pinching sleeve 260 upward towards the end of the clamping sleeve 270. Accordingly, the actuation rods 290 can move the pinching sleeve 260 from a released position to a pinching position.

Figure 5:
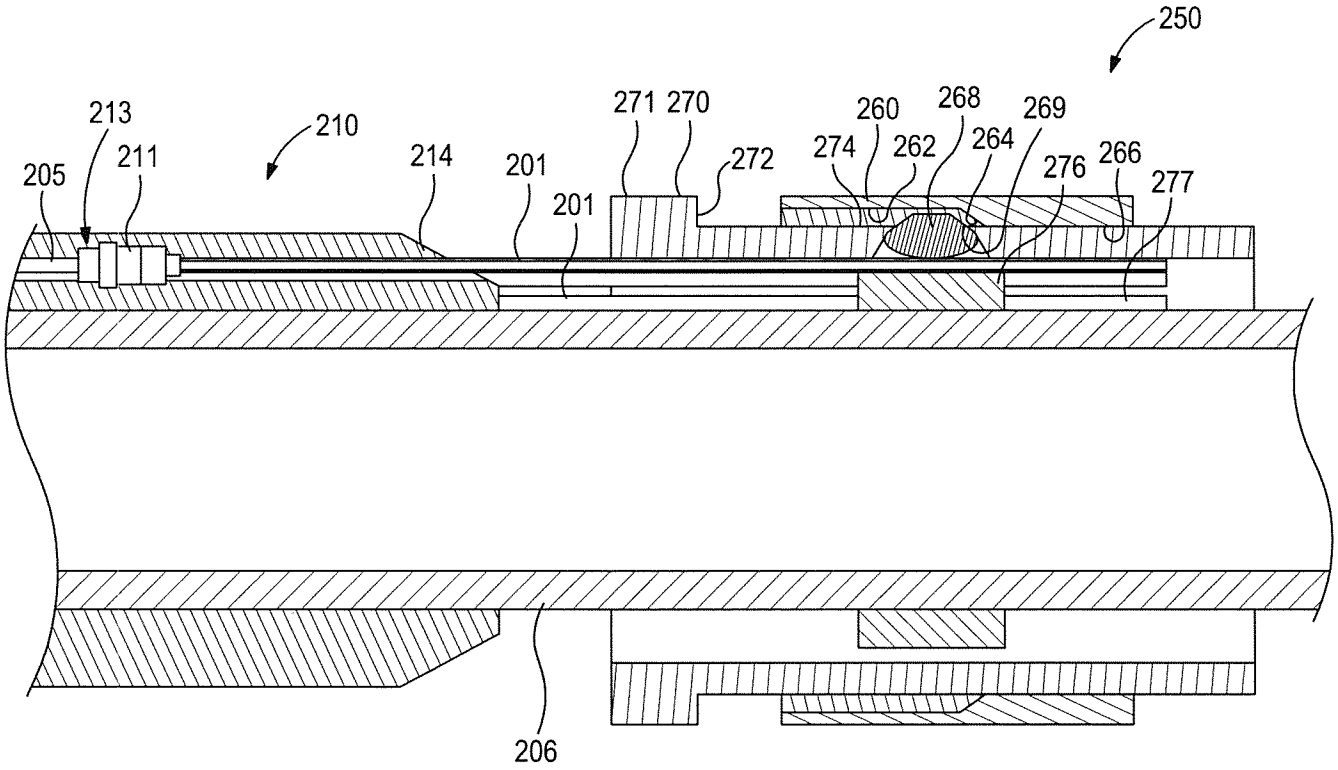
FIG. 5 is a cross-sectional view of the control line pinching mechanism of FIG. 4, taken along lines 5-5 of FIG. 4, wherein the control line pinching mechanism is in a released position, according to some embodiments.

FIG. 5 is a cross-sectional view of the control line pinching mechanism of FIG. 4, taken along lines 5-5 of FIG. 4, wherein the control line pinching mechanism is in a released position, according to some embodiments. As illustrated, the upper control line 205 is coupled to the lower control line 201 via the upper termination 213 and the lower termination 211. In the released position, the control line pinching mechanism 250 permits flow between the upper control lines 205 and the lower control lines 201 to permit flow therethrough. Therefore, in the released position, the control line pinching mechanism 250 can facilitate control of intelligent completion equipment and other downhole tools in locations downhole of the splice sub.

As shown, the pinching sleeve 260 is in a released position that does not pinch, occlude, or otherwise to restrict flow through the lower control lines 201. In the released position, the pinching sleeve 260 can be positioned to radially align the first or uphole inner surface 262 with the pinching block 268. In the depicted example, the uphole inner surface 262 of the pinching sleeve 260 does not force the pinching block 268 into the lower control lines 201.

For example, during operation, the pinching sleeve 260 can be actuated uphole to a pinching position, wherein contact surfaces such as the tapered surface 264 and the downhole inner surface 266 of the pinching sleeve 260 impinge on the a pinching block 268 to radially compress the pinching block 268, thereby radially compressing the lower control line 201.

As shown, the uphole inner surface 262 is disposed around the tubing 206 and defines a first inner diameter. The uphole inner surface 262 and the tubing 206 can further define a first radial height therebetween. In some embodiments, when in the released position, the pinching sleeve 260 can act as a protective sleeve over the lower control lines 201 and the pinching block 268 disposed within.

As illustrated, the radial height between the uphole inner surface 262 and the tubing 206 can be greater than the combined height of the unobstructed lower control line 201 and the pinching block 268 thereupon. Therefore, in the released position, the uphole inner surface 262 may not contact the pinching block 268, thereby allowing flow through the lower control lines 201.

In some embodiments, in the released position, the radial height between the uphole inner surface 262 and the tubing 206 can be less than the unobstructed lower control line 201 and the pinching block 268 thereupon. Therefore, in the released position, the uphole inner surface 262 may contact the pinching block 268, without forcing the pinching block 268 into the lower control lines 201, to permit flow through the lower control lines 201.

Optionally, in the released position, the tapered surface 264 and the downhole inner surface 266 of the pinching sleeve 260 generally may be positioned axially away from the pinching block 268. In some embodiments, the tapered surface 264 and the downhole inner surface 266 of the pinching sleeve 260 do not cover the lower control lines 201. Therefore, in the released position, the pinching sleeve 260 may not contact the pinching block 268, thereby allowing flow through the lower control lines 201.

As illustrated, the clamping sleeve 270 can axially retain the pinching block 268 as the pinching block 268 rests upon the lower control lines 201. As shown, the pinching block 268 can be disposed within a circumferential slot 274 extending through the clamping sleeve 270 (e.g. shown in FIGS. 4-6). Therefore, the pinching block 268 can be aligned with the lower control lines 201 to permit pinching of the lower control lines 201 in the pinching position.

Further, the clamping sleeve 270 can retain and protect the lower control lines 201 therein. The clamping sleeve 270 can extend axially around a portion of the lower control lines 201. A control line guide 276 can further circumferentially align the lower control lines 201 passing through guide channels 277.

FIG. 6 is a cross-sectional view of the control line pinching mechanism of FIG. 4, taken along lines 5-5, wherein the control line pinching mechanism is in a pinching position, according to some embodiments. As previously described, after cutting and separating the upper tubing from the lower tubing, the upper control line can be separated from the lower termination 211 and the lower control line 201. Further, the uphole movement of the upper tubing can actuate the control line pinching mechanism 250 to the pinching position. In the pinching position, the control line pinching mechanism 250 pinches the separated lower control line 201 to prevent spillage or cross flow to or from the lower control lines 201.

As shown, the pinching sleeve 260 is in a pinching position that pinches, occludes, or otherwise causes to restrict flow through the lower control lines 201. In the pinching position, the pinching sleeve 260 can be positioned to radially align the second or downhole inner surface 266 with the pinching block 268. In the depicted example, the downhole inner surface 266 of the pinching sleeve 260 forces the pinching block 268 downward to compress, crimp, pinch, occlude, or otherwise restrict the lower control lines 201.

As shown, the downhole inner surface 266 is disposed around the tubing 206 and defines a second inner diameter. The downhole inner surface 266 and the tubing 206 can further define a second radial height therebetween.

As illustrated, the radial height between the downhole inner surface 266 and the tubing 206 can be less than the unobstructed lower control line 201 and the pinching block 268 thereupon. Therefore in some embodiments, in the pinching position, the downhole inner surface 266 forces the pinching block 268 downward into the lower control line 201, to pinch the lower control line 201 between the pinching block 268 and the tubing 206. For example, the pinching block 268 can operate to compress or pinch the lower control line 201 from an initial unobstructed control line height to a compressed, pinched, or otherwise obstructed control line height that appreciably prevents or restricts flow through the flow channel formed therethrough. By compressing or pinching the lower control line 201, the control line lumen or flow channel therein can be partially or completely obstructed. Walls of the flow channel may be pushed together to obstruct flow through the flow channel. Optionally, materials of the lower control line 201 can be selected that allow for compression, pinching, or obstruction of the flow channel therethrough. Leakage from the lower control line 201 can be restricted or prevented by pinching or closing the lower control line 201 by utilizing the control line pinching mechanism 250. Therefore, spillage and cross-flow after plugging and abandoning operations, or other operations that may require disconnection or separation of the lower control line 201 can be prevented.

To facilitate actuation of the pinching sleeve 260 from the released position to the pinching position, the pinching sleeve 260 can include a tapered surface 264. The tapered surface 264 can form an area of reducing inner diameter that transitions to the second inner diameter of the downhole inner surface 266. Similarly, the tapered surface 264 and the tubing 206 can define an area of reducing radial height that transitions to the second radial height. Therefore, during the transition from the released position to the pinching position, the tapered surface 264 gradually forces the pinching block 268 downward prior to the pinching block 268 engaging the downhole inner surface 266.

In some embodiments, in addition to pinching the lower control line 201, the pinching position may further deform the pinching block 268. For example, as the pinching block 268 is forced downward into the lower control line 201, the pinching block 268 can be compressed and/or deformed. Optionally, the pinching block 268 can be compressed to a reduced pinching block height in the pinching position. Further, the pinching block 268 can deformed and expand in width to an expanded pinching block width.

Additionally, pinching blocks 268 may optionally include dimpled features to facilitate pinching of the lower control lines 201. In some embodiments, the pinching block 268 is coupled to the clamping sleeve 270. Further, the pinching block 268 may pivot downward or inward toward the lower control line 201 relative to the clamping sleeve 270 as the pinching sleeve 260 is moved uphole. Optionally, the pinching block 268 can be cut or formed from a portion of the clamping sleeve 270.

The control line pinching mechanism 250 can include one or more pinching blocks 268. The number of pinching blocks 268 can correspond with the number of lower control lines 201 to be pinched. Further, a plurality of pinching blocks can be coupled to move together.

Similarly, the pinching block 268 can include a tapered block surface 269 that facilitates relative movement between the pinching block 268 and the pinching sleeve 260.

Once movement of the upper tubing actuates the pinching sleeve 260 to the pinching position, the pinching sleeve 260 can be prevented or limited from further uphole travel. In the depicted example, the pinching sleeve 260 can engage against a shoulder 272 of the clamping sleeve 270 to prevent the pinching sleeve 260 from axially travelling beyond the upper end 271 of the clamping sleeve 270. To continue retrieving the upper tubing, shear devices coupling the actuation rods to the upper tubing are shorn to allow the upper tubing to be retrieved from the wellbore.

After separating the pinching sleeve 260 from the upper tubing, the upper tubing can be retrieved. Upon retrieval, further plugging and abandoning operations can continue. In some embodiments, the lower tubing and annulus remaining downhole can be cemented.

Various examples of aspects of the disclosure are described below as clauses for convenience. These are provided as examples, and do not limit the subject technology.

Clause 1. A control line pinching mechanism, comprising: a pinching sleeve having an inner surface; a clamping sleeve extending within the pinching sleeve and having a slot extending circumferentially about the clamping sleeve; tubing extending within the clamping sleeve; a control line disposed radially between the tubing and the slot of the clamping sleeve; and a pinching block disposed within the slot of the clamping sleeve, the pinching block being radially movable within the slot, wherein the pinching sleeve is movable relative to the slot from a released position to a pinching position in which the pinching sleeve contacts and radially compresses the pinching block against the control line to pinch the control line against the tubing.

Clause 2. The control line pinching mechanism of Clause 1, wherein the pinching sleeve has an uphole end portion with a first inner diameter and a downhole end portion with a second inner diameter, wherein the second inner diameter is less than the first inner diameter.

Clause 3. The control line pinching mechanism of Clause 2, the tubing having a tubing outer surface defining a first radial height between the tubing outer surfaces and the first inner diameter, and a second radial height between the tubing outer surface and the second inner diameter.

Clause 4. The control line pinching mechanism of Clause 3, wherein the pinching block has a pinching block height and the control line has an unobstructed control line height, and the pinching block height and the unobstructed control line height form a combined height greater than the second radial height.

Clause 5. The control line pinching mechanism of Clause 4, wherein in the pinching position, the control line having an obstructed control line height less than the unobstructed control line height to facilitate obstructing a flow channel of the control line.

Clause 6. The control line pinching mechanism of Clause 2, further comprising a tapered surface extending between the uphole end portion and the downhole end portion.

Clause 7. The control line pinching mechanism of Clause 2, wherein the clamping sleeve includes a shoulder with an outer diameter larger than the first inner diameter of the pinching sleeve to limit travel of the pinching sleeve.

Clause 8. The control line pinching mechanism of any preceding clause, wherein in the pinching position, the pinching block having a deformed pinching block height less than an initial pinching block height.

Clause 9. The control line pinching mechanism of Any preceding clause, wherein in the pinching position, the pinching block having a deformed pinching block width greater than an initial pinching block width.

Clause 10. The control line pinching mechanism of Any preceding clause, wherein the control line comprises a plurality of control lines.

Clause 11. The control line pinching mechanism of Clause 10, wherein the pinching block comprises a plurality of pinching blocks.

Clause 12. The control line pinching mechanism of Any preceding clause, further comprising a control line guide coupled to the tubing, the control line guide having an axial groove, wherein the control line extends through the axial groove.

Clause 13. The control line pinching mechanism of any preceding clause, wherein the control line includes a control line termination coupled to a flow channel, wherein the control line termination is axially spaced apart from the pinching block.

Clause 14. The control line pinching mechanism of any preceding clause, further comprising: an upper sleeve releasably coupled to the tubing, the upper sleeve axially spaced apart from the pinching sleeve; and an actuation rod coupling the upper sleeve to the pinching sleeve.

Clause 15. The control line pinching mechanism of Clause 14, further comprising a shear device releasably coupling the upper sleeve to the tubing.

Clause 16. The control line pinching mechanism of Clause 14, wherein the tubing includes a cut zone portion disposed between the upper sleeve and the pinching sleeve.

Clause 17. The control line pinching mechanism of Clause 14, wherein the actuation rod includes a plurality of actuation rods.

Clause 18. A method for abandoning a well, the method comprising: cutting a tubing to define an upper tubing and a lower tubing; pulling the upper tubing uphole away from the lower tubing; and pinching a lower control line coupled to the lower tubing.

Clause 19. The method of Clause 18, further comprising separating an upper control line coupled to the upper tubing from the lower control line.

Clause 20. The method of Clause 18 or 19, further comprising cutting an electrical line extending between the upper tubing and the lower tubing.

Clause 21. The method of Clauses 18-20, further comprising retrieving the upper tubing.

Clause 22. The method of Clause 21, wherein an upper control line is coupled to the upper tubing.

Clause 23. The method of Clause 21, wherein an upper electrical line is coupled to the upper tubing.

Clause 24. The method of Clauses 18-23, further comprising cementing the lower tubing within the well.

Clause 25. The method of Clauses 18-24, wherein pulling the upper tubing further comprises pulling a pinching sleeve disposed around the lower control line.

Clause 26. The method of Clause 25, wherein an actuation rod couples the upper tubing to the pinching sleeve.

Clause 27. The method of Clause 25, wherein the pinching sleeve moves longitudinally with the upper tubing.

Clause 28. The method of Clauses 18-27, further comprising pinching the lower control line with a pinching block.

Clause 29. The method of Clause 28, wherein the pinching block moves radially to pinch the lower control line.

Clause 30. A splice sub to facilitate disconnection and pinching of a control line, the splice sub comprising: a control line pinching mechanism, including: a pinching sleeve having an inner surface; a clamping sleeve extending within the pinching sleeve and having a slot extending circumferentially about the clamping sleeve; tubing extending within the clamping sleeve; a lower control line disposed radially between the tubing and the slot of the clamping sleeve, the lower control line ending at a lower control line termination; and a pinching block disposed within the slot of the clamping sleeve, the pinching block being radially movable within the slot, wherein the pinching sleeve is movable relative to the slot from a released position to a pinching position in which the pinching sleeve contacts and radially compresses the pinching block against the lower control line to pinch the lower control line against the tubing; and a control line splice bracket coupled to the tubing, the control line splice bracket axially spaced apart from the pinching sleeve, the control line splice bracket having an axial retention channel, wherein the lower control line termination is coupled within the axial retention channel.

Clause 31. The splice sub of Clause 30, further comprising an upper control line in fluid communication with the lower control line, wherein the upper control line is releasably coupled to the lower control line termination with an upper lower control line termination.

Clause 32. The splice sub of Clause 30 or 31, further comprising an electrical line extending through the control line splice bracket and the clamping sleeve.

Clause 33. The splice sub of Clause 32, further comprising a cutter disposed adjacent to the electrical line within the control line splice bracket.

Clause 34. The splice sub of Clauses 30-33, wherein the pinching sleeve has an uphole end portion with a first inner diameter and a downhole end portion with a second inner diameter, wherein the second inner diameter is less than the first inner diameter.

Clause 35. The splice sub of Clause 34, the tubing having a tubing outer surface defining a first radial height between the tubing outer surfaces and the first inner diameter, and a second radial height between the tubing outer surface and the second inner diameter.

Clause 36. The splice sub of Clause 35, wherein the pinching block has a pinching block height and the control line has an unobstructed control line height, and the pinching block height and the unobstructed control line height form a combined height greater than the second radial height.

Clause 37. The splice sub of Clause 36, wherein in the pinching position, the control line having an obstructed control line height less than the unobstructed control line height to facilitate obstructing a flow channel of the control line.

Clause 38. The splice sub of Clause 34, further comprising a tapered surface extending between the uphole end portion and the downhole end portion.

Clause 39. The splice sub of Clause 34, wherein the clamping sleeve includes a shoulder with an outer diameter larger than the first inner diameter of the pinching sleeve to limit travel of the pinching sleeve.

Clause 40. The splice sub of Clauses 30-39, wherein in the pinching position, the pinching block having a deformed pinching block height less than a pinching block height.

Clause 41. The splice sub of Clauses 30-40, wherein in the pinching position, the pinching block having a deformed pinching block width greater than an initial pinching block width.

Clause 42. The splice sub of Clauses 30-41, wherein the control line comprises a plurality of control lines.

Clause 43. The splice sub of Clause 42, wherein the pinching block comprises a plurality of pinching blocks.

Clause 44. The splice sub of Clauses 30-43, further comprising a control line guide coupled to the tubing, the control line guide having an axial groove, wherein the control line extends through the axial groove.

Clause 45. The splice sub of Clauses 30-44, further comprising: an upper sleeve releasably coupled to the tubing, the upper sleeve axially spaced apart from the pinching sleeve; and an actuation rod coupling the upper sleeve to the pinching sleeve.

Clause 46. The splice sub of Clause 45, further comprising a shear device releasably coupling the upper sleeve to the tubing.

Clause 47. The splice sub of Clause 45, wherein the tubing includes a cut zone portion disposed between the upper sleeve and the control line splice bracket.

Clause 48. The splice sub of Clause 45, wherein the actuation rod includes a plurality of actuation rods.

Clause 49. The splice sub of Clause 45, wherein the actuation rod passes through an actuation rod channel formed through the control line splice bracket.

What is claimed is:

1. A control line pinching mechanism, comprising:

a pinching sleeve having an inner surface;

a clamping sleeve extending within the pinching sleeve and having a slot extending circumferentially about the clamping sleeve;

tubing extending within the clamping sleeve;

a control line disposed radially between the tubing and the slot of the clamping sleeve; and a pinching block disposed within the slot of the clamping sleeve, the pinching block being radially movable within the slot, wherein the pinching sleeve is movable relative to the slot from a released position to a pinching position in which the pinching sleeve contacts and radially compresses the pinching block against the control line to pinch the control line against the tubing.

2. The control line pinching mechanism of claim 1, wherein the pinching sleeve has an uphole end portion with a first inner diameter and a downhole end portion with a second inner diameter, wherein the second inner diameter is less than the first inner diameter.

3. The control line pinching mechanism of claim 2, further comprising a tapered surface extending between the uphole end portion and the downhole end portion.

4. The control line pinching mechanism of claim 1, wherein in the pinching position, the pinching block having a deformed pinching block height less than an initial pinching block height.

5. The control line pinching mechanism of claim 1, wherein in the pinching position, the pinching block having a deformed pinching block width greater than an initial pinching block width.

6. The control line pinching mechanism of claim 1, further comprising a control line guide coupled to the tubing, the control line guide having an axial groove, wherein the control line extends through the axial groove.

7. The control line pinching mechanism of claim 1, wherein the control line includes a control line termination coupled to a flow channel, wherein the control line termination is axially spaced apart from the pinching block.

8. The control line pinching mechanism of claim 1, further comprising:

an upper sleeve releasably coupled to the tubing, the upper sleeve axially spaced apart from the pinching sleeve; and an actuation rod coupling the upper sleeve to the pinching sleeve.

9. The control line pinching mechanism of claim 8, further comprising a shear device releasably coupling the upper sleeve to the tubing.

10. The control line pinching mechanism of claim 8, wherein the tubing includes a cut zone portion disposed between the upper sleeve and the pinching sleeve.

11. The control line pinching mechanism of claim 1, wherein the control line includes a control line termination coupled to a flow channel, wherein the control line termination is axially spaced apart from the pinching block.

12. A splice sub to facilitate disconnection and pinching of a control line, the splice sub comprising:

a control line pinching mechanism, including:

a pinching sleeve having an inner surface;

a clamping sleeve extending within the pinching sleeve and having a slot extending circumferentially about the clamping sleeve;

tubing extending within the clamping sleeve;

a lower control line disposed radially between the tubing and the slot of the clamping sleeve, the lower control line ending at a lower control line termination; and a pinching block disposed within the slot of the clamping sleeve, the pinching block being radially movable within the slot, wherein the pinching sleeve is movable relative to the slot from a released position to a pinching position in which the pinching sleeve contacts and radially compresses the pinching block against the lower control line to pinch the lower control line against the tubing; and a control line splice bracket coupled to the tubing, the control line splice bracket axially spaced apart from the pinching sleeve, the control line splice bracket having an axial retention channel, wherein the lower control line termination is coupled within the axial retention channel.

13. The splice sub of claim 12, further comprising an upper control line in fluid communication with the lower control line, wherein the upper control line is releasably coupled to the lower control line termination with an upper lower control line termination.

14. The splice sub of claim 12, wherein the pinching sleeve has an uphole end portion with a first inner diameter and a downhole end portion with a second inner diameter, wherein the second inner diameter is less than the first inner diameter.

15. The splice sub of claim 12, further comprising:

an upper sleeve releasably coupled to the tubing, the upper sleeve axially spaced apart from the pinching sleeve; and an actuation rod coupling the upper sleeve to the pinching sleeve.

16. The splice sub of claim 15, wherein the actuation rod passes through an actuation rod channel formed through the control line splice bracket.

17. The splice sub of claim 12, further comprising:

a tapered surface extending between the uphole end portion and the downhole end portion.

18. The splice sub of claim 12, wherein in the pinching position, the pinching block having a deformed pinching block height less than an initial pinching block height.

19. The splice sub of claim 12, wherein in the pinching position, the pinching block having a deformed pinching block width greater than an initial pinching block width.

20. The method of claim 19 further comprising:

a control line guide coupled to the tubing, the control line guide having an axial groove, wherein the control line extends through the axial groove.

* * * * *